United States Patent [19]

Geiger

[11] 4,268,977

[45] May 26, 1981

[54] SEALING APPARATUS FOR OVENS

[75] Inventor: Joseph T. Geiger, Houston, Tex.

[73] Assignee: Exxon Research & Engineering Company, Florham Park, N.J.

[21] Appl. No.: 99,665

[22] Filed: Dec. 3, 1979

[51] Int. Cl.[3] ..... F26B 25/12

[52] U.S. Cl. ..... 34/242; 68/5 E; 432/242; 432/244

[58] Field of Search ..... 68/5 E; 34/242, 36, 34/37; 432/242, 244, 115

[56] References Cited

U.S. PATENT DOCUMENTS

| | | | |
|---|---|---|---|
| 2,231,716 | 2/1941 | Hansen . | |
| 2,977,106 | 3/1961 | Duff . | |
| 2,985,437 | 5/1961 | Sargeant . | |
| 3,147,982 | 9/1964 | Klein . | |
| 3,299,676 | 1/1967 | Fujihashi . | |
| 3,650,042 | 3/1972 | Boerger et al. | 34/242 |
| 3,667,626 | 6/1972 | Torelli et al. . | |
| 3,868,106 | 2/1975 | Donckel et al. . | |
| 3,919,854 | 11/1975 | Denis . | |
| 3,931,684 | 1/1976 | Turnbull et al. | 432/242 |
| 4,027,604 | 6/1977 | Jansson . | |
| 4,064,582 | 12/1977 | Sando et al. . | |
| 4,087,992 | 5/1978 | Sando et al. | 34/242 |
| 4,114,059 | 9/1978 | Albaric et al. . | |

*Primary Examiner*—Larry I. Schwartz
*Attorney, Agent, or Firm*—Donald F. Wohlers

[57] ABSTRACT

A non-contact seal for thin film treating ovens to prevent leakage of gas both into and out of the oven at the film entry and exit points. An inert buffer gas is introduced into a narrow sealing slit defined between a pair of upper and lower sealing members adjacent the oven opening to buffer the oven gas leakage. An eductor passage also communicates with the sealing slit to carry away gas leakage resulting from thermal diffusion. Apparatus for precisely adjusting the height of the sealing slit to compensate for various film thicknesses and widths are provided. The temperature of the sealing members is regulated by the circulation of a fluid within passageways provided therein, thus to prevent thermal distortions of the slit defining surfaces.

20 Claims, 9 Drawing Figures

SEALING APPARATUS FOR OVENS

BACKGROUND OF THE INVENTION

This invention relates generally to sealing apparatus for heat treatment ovens, and, more particularly, to non-contact sealing apparatus for thin film treatment ovens to prevent leakage of gas into and out of the ovens at the film entry and exit openings.

In the manufacture of thin films of various materials, such as plastic, it is necessary to subject the films to various heat treatment. Thus, it is not uncommon in the manufacture of such films to convey the film either on a continuous belt or over an open draw through the oven.

In the course of such manufacturing processes, it is essential to maintain a controlled environment within the oven in order to assure that the plastic product retains or acquires the desired physical characteristics. Additionally, it is important to prevent leakage of solvents expelled from the plastic during heating in the oven into the surrounding plant area.

In connection with these requirements, sealing apparatus have been designed for use at the film entry and exit points of the ovens to prevent the entry of surrounding air into the ovens as well as to prevent leakage of the solvents from within the oven into the surrounding plant area. Such sealing apparatus have generally taken one of two forms, namely contact sealing apparatus and non-contact sealing apparatus. More particularly, such contact sealing apparatus wherein sealing members contact the film are not entirely satisfactory since it is not unusual for the film to be damaged due to improper contact with the seal material. On the other hand, sealing apparatus of the non-contact variety have previously not provided a reliable seal in that leakage of gases into and out of the oven has not been entirely eliminated. This is especially true where such seals have been provided on ovens which are intended to treat films having various thicknesses. In such cases, the precise dimensional tolerances which must be maintained in order to effect a reliable seal have not been possible to obtain. Further, it has not been uncommon to experience excessive gas leakage at the sides of the seals.

Another problem inherent in the use of non-contact or clearance type seals results from the thermal gradients present in the sealing apparatus caused by the difference in temperature between the hot oven interior and the cooler outside area. Such thermal gradients give rise to a lack of dimensional stability which is necessary to insure the maintenance of close seal clearance tolerances.

SUMMARY OF THE INVENTION

Accordingly, one object of the present invention is to provide a new and improved sealing apparatus of the clearance or non-contact type for use in thin film treating ovens to prevent leakage of gas both into and out of the oven at the film entry and exit openings thereof.

Another object of the present invention is to provide a new and improved non-contact or clearance type seal for thin film treating ovens which may be precisely adjusted to afford close film clearance.

Yet another object of the present invention is to provide sealing apparatus of the above-described type which may be temperature regulated to prevent the formation of thermal gradients and the consequent lack of dimensional stability.

Briefly, in accordance with the present invention, these and other objects are attained by providing at the entrance and exit openings of a film treating oven through which a substantially continuous film is conveyed, sealing apparatus including a pair of upper and lower sealing members, sealingly engaged to the entrance and exit openings of the oven. The upper and lower sealing members have lower and upper surfaces, respectively, which extend in parallel, spaced relationship forming a narrow slit therebetween through which the film is conveyed prior to entering the oven.

Eductor apparatus fluidly communicates with the slit in an area adjacent to the free end thereof, i.e., at the slit end distant from the oven opening, while buffer gas apparatus fluidly communicates with the slit at an area between the eductor apparatus and the slit end proximate to the oven opening. The buffer apparatus introduces an inert gas into the slit thereby preventing the leakage of gases into or out of the oven while the eductor apparatus provides a suction or vacuum to remove any gases leaking into the slit due to thermal diffusion.

At least one of the sealing members is movably mounted in an oblique direction to provide a capability for a fine adjustment of the height of the sealing slit in order to maintain appropriate clearance between the slit defining surfaces and the film. Additionally, internal fluid passages are provided within the sealing members for conducting a temperature regulating fluid in order to maintain a uniform temperature throughout the sealing members to prevent thermal distortions which would otherwise occur due to the thermal gradients discussed above.

DESCRIPTION OF THE DRAWINGS

A more complete appreciation of the invention and many of the attendant advantages thereof will be readily appreciated as the same become better understood by reference to the following detailed description when considered in connection with the accompanying drawings in which.

DESCRIPTION OF THE PREFERRED EMBODIMENTS

Figure 1:
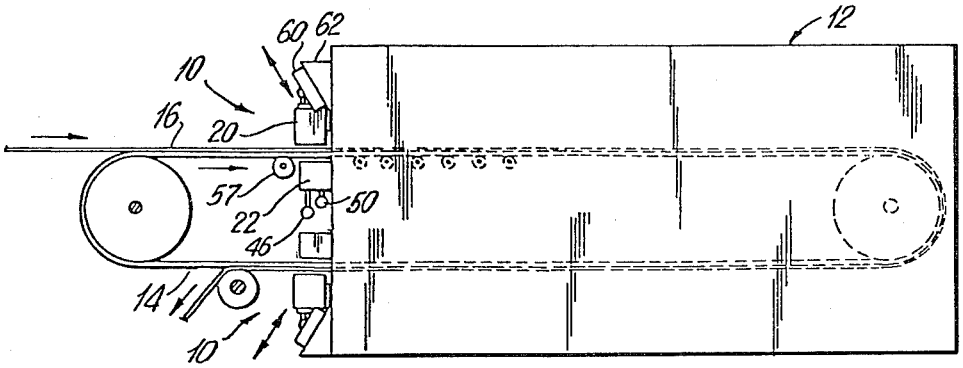
FIG. 1 is a side elevation view of a thin film treating oven having sealing apparatus at the film entry and exit points according to the present invention.

Referring now to the drawings wherein like reference characters designate identical or corresponding parts throughout the several views, and more particularly to FIG. 1, the sealing apparatus of the present invention, generally denoted as 10, are illustrated in association with an oven 12 for the treatment of thin films. In the case of oven 12, a thin film 16 is conveyed by a continuous belt 14 in the direction of the arrows associated therewith. Although thin film 16 is conveyed into oven 12 supported by belt 14, it is understood that upon subsequent heat treatment the film 16 may be conveyed over an open draw, i.e., without the aid of a supporting belt, into heat treatment ovens equipped with sealing apparatus of the present invention. Such a case is discussed in connection with FIGS. 8 and 9 hereinbelow.

Figure 3:
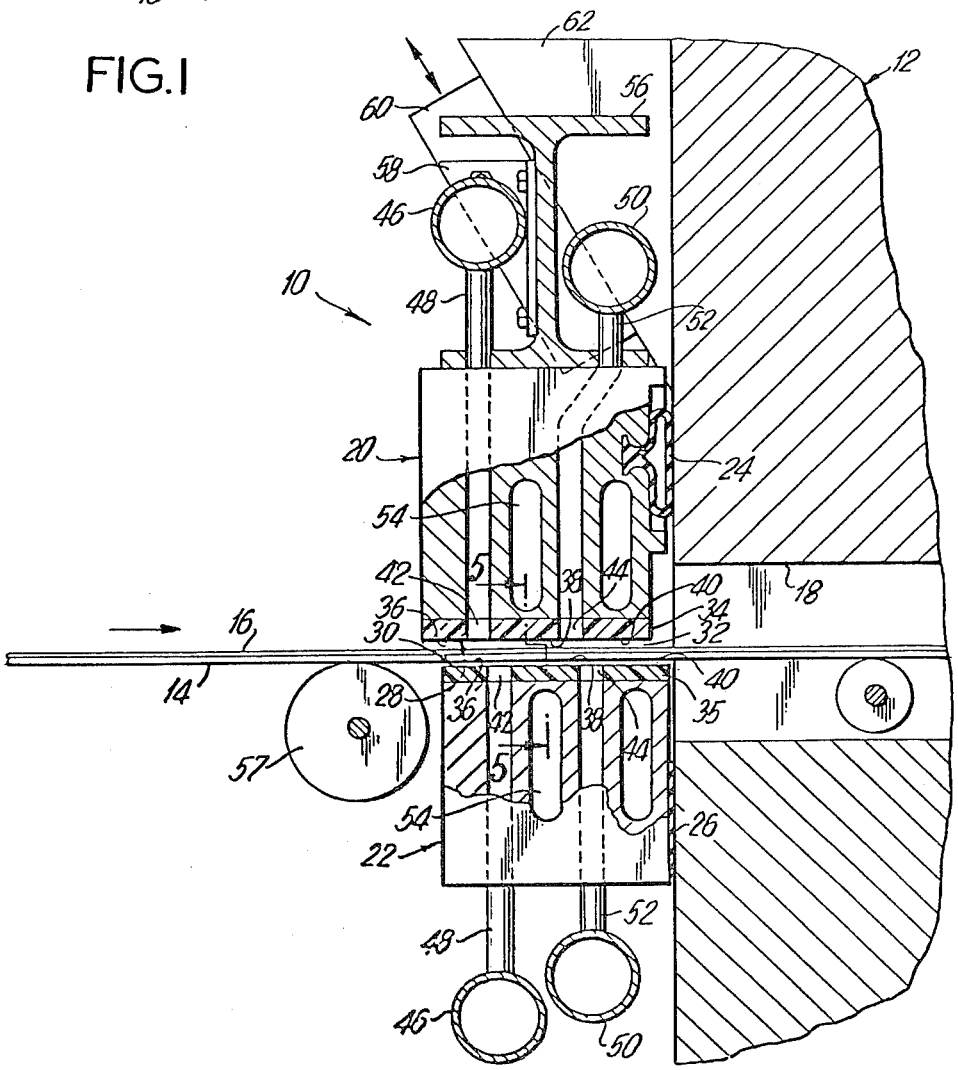
FIG. 3 is a section view of the apparatus taken through line 3—3 of FIG. 2.
Figure 2:
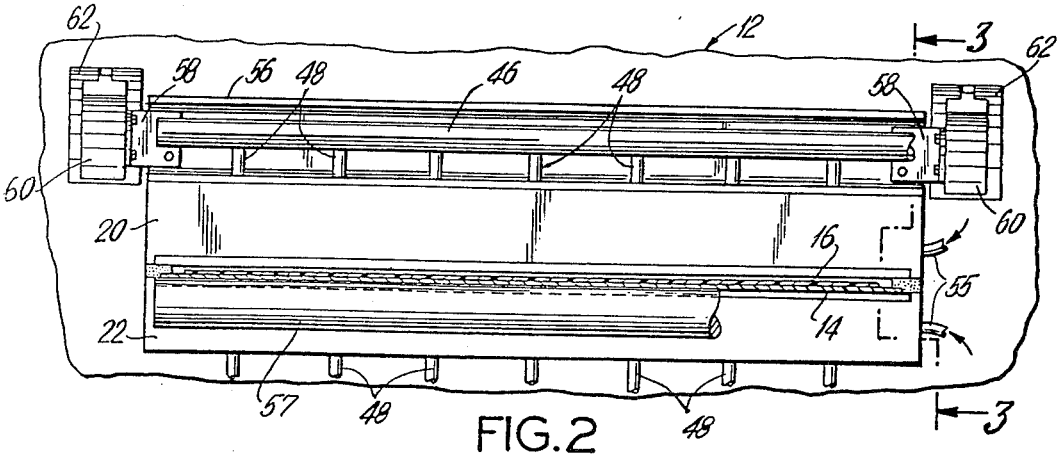
FIG. 2 is a front elevation view of the apparatus illustrated in FIG. 1.

Referring to FIG. 1 in conjunction with FIGS. 2 and 3, oven 12 receives the film 16 carried by belt 14 through an entrance opening 18 (FIG. 2) which presents a narrow, elongate opening extending substantially horizontally over the front side of oven 12. Of course, it is understood that the opening provided for the exit of the film carrying belt is substantially similarly formed.

As mentioned above, it is a primary object of the present invention to effectively seal the entrance and exit openings of a film heat treating oven to prevent leakage of gases into and out of the oven. To this end, sealing apparatus 10 are provided over each of the entrance and exit openings of the oven. More particularly, referring to the sealing apparatus provided over the oven entrance opening 18, sealing apparatus 10 includes an upper seal member 20 and a lower seal member 22 disposed vertically beneath it, each of which, in the present embodiment, has a block shaped outer configuration. As seen in FIG. 2 each seal member sealingly engages the front of the oven on either side of the entrance opening 18 over the entire width of the oven opening. Upper seal member 20 engages the side of oven 12 above opening 18 by a flexible, elastomeric sealing member 24 which permits slight movement of upper seal member 20 as discussed below while the lower seal member 22 engages the oven wall below opening 18 through an elongate gasket 26.

The upper or film side seal member 20 and the lower or belt side seal member 22 include lower and upper seal portions 34, 35, respectively, preferably formed of Teflon material. Seal portions 34, 35 in turn define upper and lower seal surfaces 28, 30, respectively, which extend in substantially parallel, opposed relationship to each other defining a gap or slit 32 between them which is in sealed communication with oven opening 18 by virtue of sealing member 24 and gasket 26.

The upper and lower slit defining surfaces 28, 30 each have a pair of transversely extending, parallel grooves or channels 42, 44 formed therethrough defining three sealing lands namely outer land 36, intermediate land 38, and inner land 40. Thus, the outer lands 36 are defined between the outer edges of the seal members and the channels 42, intermediate lands 38 are defined between channels 42 and 44, and inner lands 40 are defined between channels 44 and the inner edges of the seal members.

According to the present invention, the channels 42, 44 comprise eduction and buffer channels, respectively. Thus, referring to FIGS. 2 and 3, upper and lower manifolds 46, connected to a vacuum source (not shown) communicate through a plurality of pipes 48 extending through the sealing members 20, 22 with the eductor channels 42 in the upper and lower sealing members 20, 22.

Similarly, upper and lower manifolds 50 connected to a pressurized source of buffer gas, preferably comprising an inert gas such as nitrogen, communicate with buffer channels 44 in the upper and lower sealing members 20, 22 through a plurality of pipes 52 which extend through the sealing members 20, 22.

The outer seal lands 36 are preferably shorter than the intermediate and inner seal lands 38, 40. It has been found that, during operation as described below, this particular sizing permits a larger flow of air across outer seal lands 36, thereby providing a more reliable barrier against any gases escaping from the oven by diffusion.

A continuous passageway 54 is formed through each of the upper and lower seal members 20, 22 to accommodate the circulation of a temperature regulating fluid therethrough. Thus, for example, a coolant fluid is introduced through flexible pipe 55 (FIG. 5) communicating with passageway 54 and withdrawn through a similar pipe (not shown) of the opposite end of the passageway. Such fluid circulation maintains the temperature of the seal members at a desired level thereby minimizing any dimensional distortions which would have resulted from the presence of thermal gradients in the seal members. This is quite important since the clearance between the slit defining surfaces 28, 30 and the thin film and supporting belt must be precisely maintained.

The belt side or lower seal member 22 in the present embodiment is fixed to the oven in any conventional manner to provide for a fixed clearance between the lower slit defining surface 30 and the lower surface of belt 14. Although during the initial operation of the oven the conveyor belt can make light contact with the belt side slit defining surface 30, in the example discussed above a belt side clearance, i.e., a clearance between the lower surface of the belt and the lower slit defining surface 30, of about 0.005 inches is desirable. In this connection, a belt support roller 57 is located immediately in advance of the seal members to minimize any drooping of the belt across the slit defining surface 30, thereby minimizing any increase in clearance due to wear.

It is important that the upper or film side seal member 20 be adjustable in a precise manner in order to obtain a minimum operating clearance between the upper slit defining surface 28 and the film 16. Thus, it is desirable to provide a clearance of about 0.010 inches between upper slit defining surface 28 and the film 16 in the example discussed above. It is therefore clear that it is important for the upper or film side seal member 20 to be precisely vertically positionable with respect to the film. To this end, provision is made to adjust the position of the upper or film side seal member 20 along an obliquely inclined plane so that an extremely sensitive adjustment may be obtained. In this connection, referring to FIGS. 2–4, an I-beam 56 has its lower flange fixed to the top of upper seal member 20. The ends (only one shown) of I-bar 56 are fastened by brackets 58 to carriage members 60 which are movably disposed in a dovetail slot formed within obliquely extending inclined surfaces of members 62. Accordingly, indexing of carriage members 60 within the dovetail slots in guide members 62 results in movement of the upper or film side seal member 20 in an oblique direction toward or away from the oven. The carriage members 60 are coupled to guide members 62 through a conventional worm gear arrangement so that precise movement of the carriage member 60, with respect to the guide member 62 may be accomplished. It is seen that the upper sealing member 20 remains in sealed engagement with the oven during movement thereof by virtue of the flexible, elastomeric seal 24 which accommodates for any such movement. Since the upper or film side seal member 20 is supported at both of its ends by identical carriage and guide members (as seen in FIG. 2), the same worm gear arrangement is adapted to control the indexing of both of these assemblies simultaneously so that the upper and lower slit defining surfaces remain parallel. Further, the use of I-beam 56 has the further advantage of minimizing any deflection of the upper slit defining surface 28 along its width due to bowing.

Figure 4:
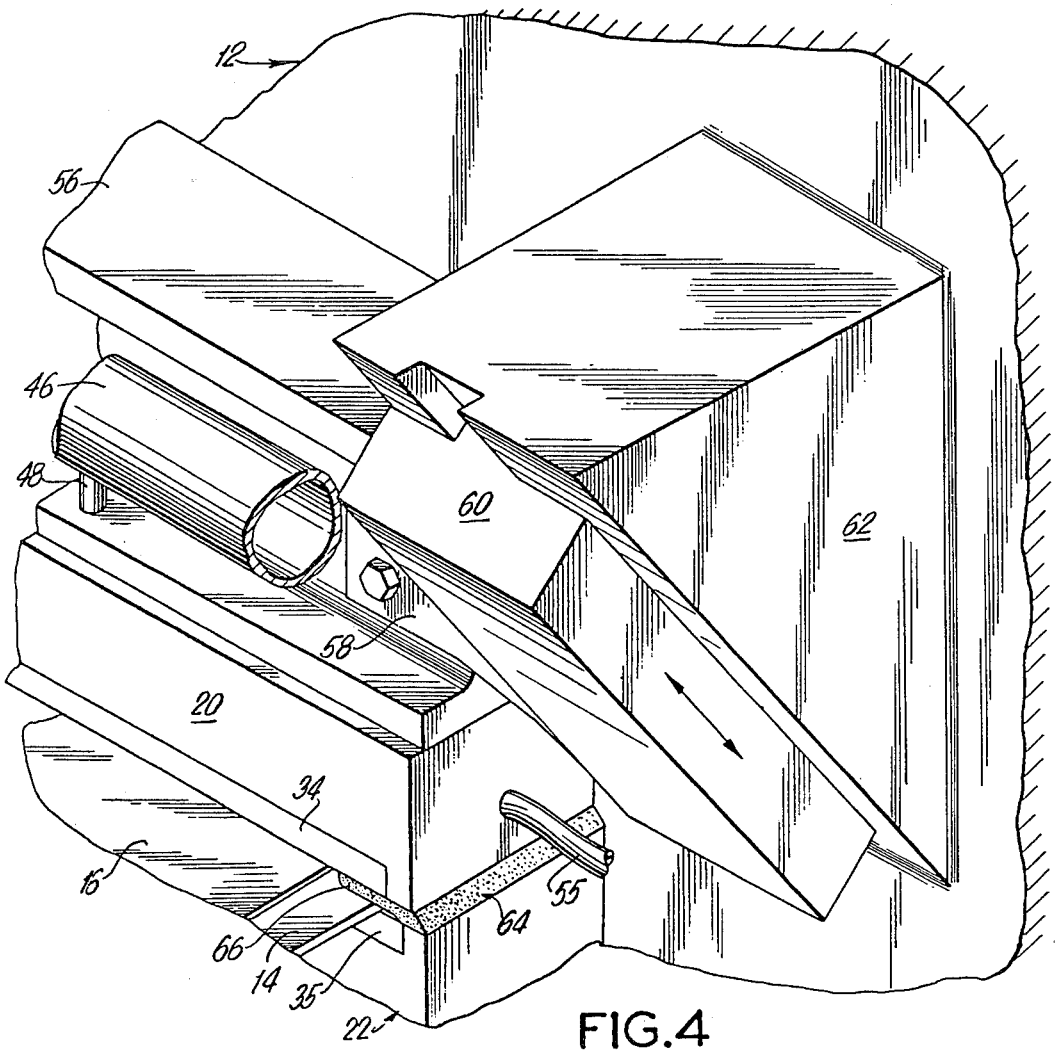
FIG. 4 is a partial perspective view of the sealing apparatus of the present invention illustrating apparatus for adjusting the clearance of the sealing apparatus and film.
Figure 5:
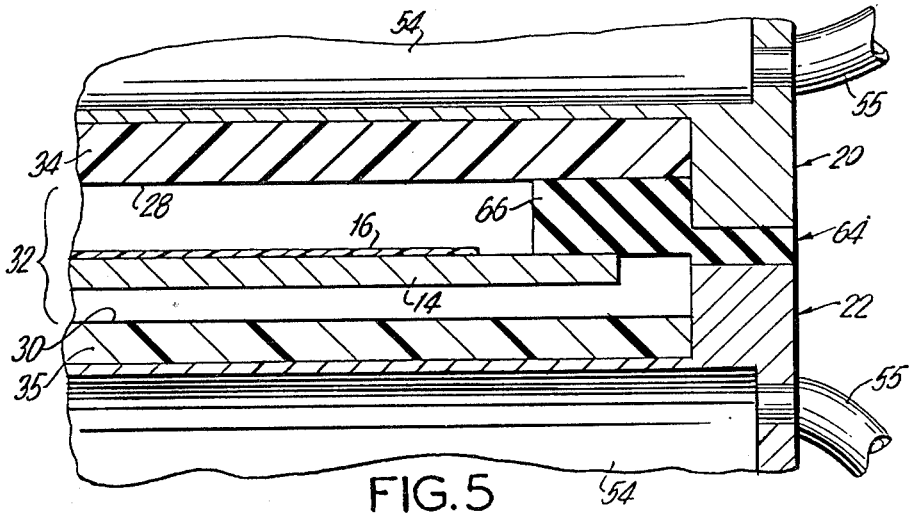
FIG. 5 is a partial section view taken through line 5—5 of FIG. 3 illustrating apparatus for sealing the sides of the sealing slit.

Referring to FIGS. 4 and 5, the transverse ends of slit 32 are each sealed by an elastomeric sealing element 64 which is interposed between the opposed edge surfaces of upper and lower sealing members 20, 22. The elastomeric side sealing elements 64 each preferably include a portion 66 which extends inwardly into gap 32 having sealing contact with the belt 14 and the film side or upper gap defining surface 28. By this means leakage from the oven is prevented or at least minimized from the slit at the sides of the belt, the sides of the film and, further, along the opposed surfaces of the upper and lower seal members 20, 22.

Figure 6:
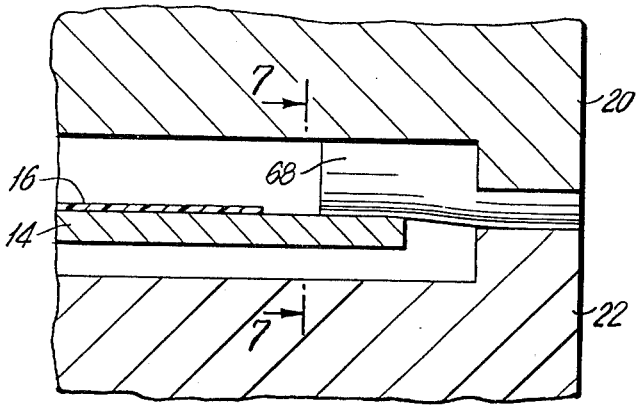
FIG. 6 is a view similar to FIG. 5 illustrating another embodiment of the side sealing apparatus.
Figure 7:
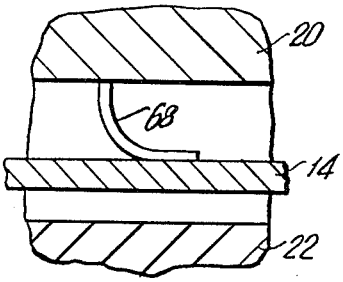
FIG. 7 is a section view taken along line 7—7 of FIG. 6.

Referring to FIGS. 6 and 7, another embodiment of side seals is shown including a brush type seal element 68 comprising a flexible strip having its upper edge fixed to the film side seal member 20 and the lower end portion thereof having rubbing contact with both the upper surface of belt 14 and the opposed surface of the belt side or lower seal member 22.

In operation, the upper and lower eductor manifolds 46 are connected to a vacuum source while the upper and lower buffer manifolds 50 are connected to a source of pressurized inert gas, such as, for example, nitrogen ($N_2$). The film 16 supported by belt 14 is conveyed through the gap or slit 32 between the upper and lower sealing member 20, 22 into oven opening 18. While the film supporting belt is conveyed through gap 32, nitrogen buffer gas flows through upper and lower buffer channels 44 both into the oven across the inner seal land 40 and also into eductor channels 42 to manifolds 46 across intermediate lands 38. At the same time air is drawn into slit 32 across the outer seal land 36 into eductor channels 42 to manifolds 46. As mentioned hereinabove, the outer seal land 36 is preferably shorter than the intermediate and inner seal lands 38, 40 in order to permit a larger flow of air across the outer seal land which provides a barrier against the escape of solvent gases from the oven by diffusion. The air and buffer gas leakage through the eductor channels 42 of the seal is drawn into manifolds 46. It has been found that the use of this structure effectively prevents the leakage of gases both into and out of the oven.

As mentioned hereinabove, the invention has use in connection with heat treatment ovens other than the conveyor type oven of FIG. 1. For example, referring to FIGS. 8 and 9, sealing apparatus 70 according to the present invention is shown in use with an oven 72 which may comprise either a heat treatment oven or a drying oven. In either case, a film 74 is conveyed over an open draw (i.e. not supported by a belt) through sealing apparatus 70 which is essentially similar in structure to the sealing apparatus 10 described hereinabove. In the present embodiment, however, an idler roller 76 is mounted in an eccentric support 80 affixed to the lower sealing member 78. The eccentric support 80 permits small adjustments to be made in the height of the roller 76 relative to the slit defining surface 79 of lower sealing member 78. This is desirable in order to minimize clearance between the film and the lower slit defining surface.

Figure 8:
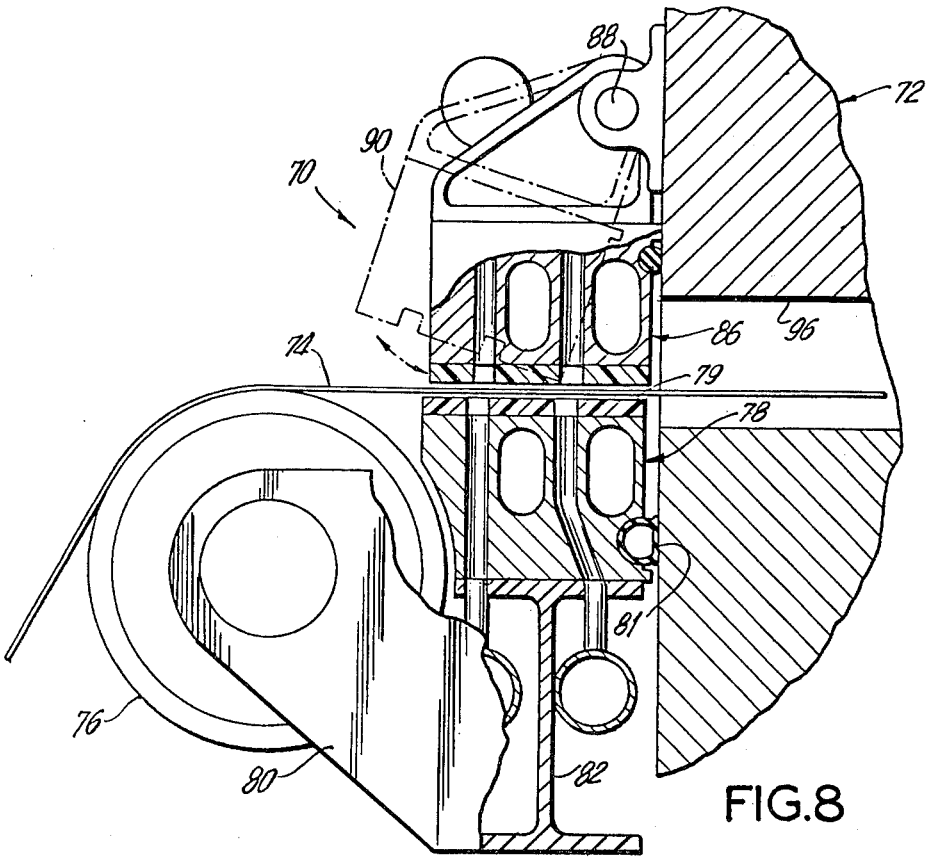
FIG. 8 is a side view in partial section of another embodiment of the sealing apparatus of the present invention.
Figure 9:
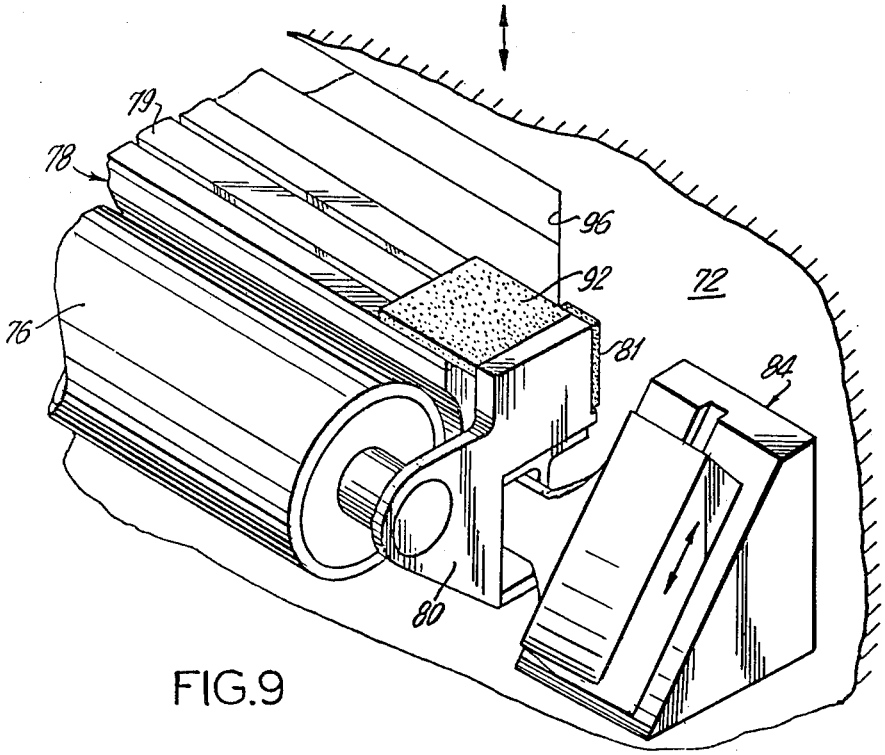
FIG. 9 is a partial perspective view of the sealing apparatus illustrated in FIG. 8.

Referring to FIG. 9, the lower sealing member 78 is shown in position adjacent the oven opening 96 with the upper seal member 86 removed. The lower sealing member 78 and idler roller 76 are movable together in an oblique direction by connection through an I-beam 82 (FIG. 8) to a carriage-guide assembly 84 similar to the analogous structure described hereinabove. Thus, the clearance of the lower sealing member 78 relative to the film can be extremely finely adjusted through a worm driven micrometer screw (not shown). In a manner similar to that described in connection with the previously disclosed embodiment, the worm drive shaft preferably extends between the opposite ends of the seal member (where similar carriage-guide apparatus is provided) to permit adjustment of both side simultaneously to maintain parallelism between the slit defining surfaces. It is seen in FIG. 8 that lower seal member 78 is provided with a flexible compressible sealing element 81 so that lower seal member 78 maintains sealing engagement with the side of the oven.

Referring back to FIG. 8, the upper seal member 86 is pivotally connected to the oven wall through a hinge pin 88 to facilitate loading of the film into the oven. Thus, the upper seal member 86 may be pivoted to the position shown in phantom, designated 90. It should be noted that the eductor and buffer manifolds associated with the upper seal member 86 should be located so as to permit a minimum swing of about 135° of the upper seal member 86. As shown in FIG. 9, compressible elastomer seals 92 are provided on the ends of lower slit defining surface 79 to seal the sides of the slit when the upper seal member 86 is lowered into position. The seals 92 also define the length of the gap in accordance with the width of the film being conveyed therethrough.

Obviously, numerous modifications and variations of the present invention are possible in the light of the above teachings. It is therefore to be understood that within the scope of the appended claims the invention may be practiced otherwise than as specifically described herein.

What is claimed is:

1. In a film treating oven having substantially wide and narrow entrance and exit openings for a substantially continuous thin film conveyed therethrough for treatment therewithin, sealing apparatus comprising:

means for defining a substantially narrow slit sealingly engaged with at least one of said oven entrance and exit openings extending both across the width of and longitudinally with respect to said oven opening having an end proximal to said oven opening and a free end distal thereto, said slit being dimensioned such that the film is conveyable therethrough into or out of said oven, said slit defining means including upper and lower sealing members sealingly engaged to and extending transversely over said oven opening and having upper and lower, opposed, substantially parallel slit defining surfaces, respectively;

eductor means fluidly communicating with said slit in an area adjacent to the distal end thereof for educing gases present in said slit;

buffer means fluidly communicating with said slit in an area between said area wherein said eductor means communicates with said slit and the proximal end thereof for introducing an inert gas into said slit; and means for selectively adjusting the position of at least one of said upper and lower sealing members to adjust the height of said slit, at least one of said sealing members being sealingly engaged to said oven openings by a flexible seal, whereby gases leaking from the oven through the openings thereof are prevented from reaching the atmosphere external of said oven through the action of one or both of the flow of inert gas and ambient atmosphere exterior of said oven into said eductor means while the ambient atmosphere is prevented from entering the oven.

2. Sealing apparatus as recited in claim 1 wherein said position adjusting means includes means for moving one of said upper and lower sealing members in an oblique direction while maintaining its slit defining surface substantially parallel to the other slit defining surface, said flexible seal accommodating any relative movement between said oven and said sealing member.

3. Sealing apparatus as recited in claim 2 wherein said means for moving said sealing member in an oblique direction includes a guide block affixed to a side wall of said oven, said guide block having an oblique guide surface, a follower member movably affixed to said guide block surface and worm gear means for adjusting the relative location of said follower member on said guide block, said sealing member being affixed to said follower member.

4. Sealing apparatus as recited in claim 1 wherein said upper and lower sealing members have lower and upper sealing portions, respectively, formed of Teflon material, defining said lower and upper opposed, parallel, slit defining surfaces.

5. Sealing apparatus as recited in claim 1 further including means for regulating the temperature of said sealing members.

6. Sealing apparatus as recited in claim 5 wherein said temperature regulating means comprise passageways formed in said sealing members for circulating a temperature regulating fluid therewithin.

7. Sealing apparatus as recited in claim 1 wherein said eductor means comprises conduit means extending through at least one of said sealing members connectable to a vacuum source and an eductor channel formed in said slit defining surface communicating between said slit and said conduit means, said eductor channel extending over the substantial width of said slit substantially parallel to the oven opening.

8. Sealing apparatus as recited in claim 1 wherein said buffer means comprises buffer gas conduit means extending through at least one of said sealing members connectable to a source of buffer gas under pressure and a buffer channel formed in said slit defining surface communicating between said slit and said conduit means, said buffer channel extending over the substantial width of said slit substantially parallel to the oven opening.

9. Sealing apparatus as recited in claim 8 wherein said eductor means comprises eduction conduit means extending through at least one of said sealing members connectable to a vacuum source and an eductor channel formed in said slit defining surface communicating between said slit and said eduction conduit means, said eduction channel extending over the substantial width of said slit between the distal end of said slit and said buffer channel substantially parallel to said buffer channel.

10. Sealing apparatus as recited in claim 9 wherein said buffer and eduction channels define in said slit surface an outer seal land extending between the distal end of said slit and said eduction channel, an intermediate seal land extending between said eduction and buffer channels, and an inner seal land extending between said buffer channel and said proximal end of said slit.

11. Sealing apparatus as recited in claim 10 wherein the length of said outer seal land is less than the length of either of said intermediate and inner seal lands.

12. Sealing apparatus as recited in claim 11 wherein the length of said intermediate and inner seal land are substantially equal.

13. Sealing apparatus as recited in claim 10 wherein said buffer and eductor means are provided in both of said sealing members.

14. Sealing apparatus as recited in claim 1 further including side sealing means located between said upper and lower sealing members interengaging said upper and lower slit defining surfaces at transverse end portions thereof.

15. Sealing apparatus as recited in claim 14 wherein said side sealing means comprises an elastomer filler material.

16. Sealing apparatus as recited in claim 14 wherein said side sealing means comprises a brush seal including an elongated strip of flexible material having one end affixed to one of said sealing members and the other end in rubbing contact with the other of said sealing members.

17. Sealing apparatus as recited in claim 14 wherein said side sealing means includes a portion which extends into said slit, said side sealing portion engaging one of said upper and lower slit defining surfaces and adapted for engagement with a continuous belt supporting said film.

18. Sealing apparatus as recited in claim 1 further including means for pivoting at least one of said upper and lower sealing members away from said oven opening.

19. Sealing apparatus as recited in claim 1 further including idler roller means and means for adjusting the position of said roller means with respect to one of said sealing members.

20. Sealing apparatus as recited in claim 19 wherein said adjusting means comprises an eccentric mount whereby the height of the roller may be adjusted relative to the height of the sealing member to which it is engaged.

* * * * *